US011812788B2

(12) United States Patent
Liu

(10) Patent No.: US 11,812,788 B2
(45) Date of Patent: Nov. 14, 2023

(54) TOBACCO ROASTER

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 449 days.

(21) Appl. No.: 17/096,992

(22) Filed: Nov. 13, 2020

(65) Prior Publication Data

US 2021/0235764 A1 Aug. 5, 2021

(30) Foreign Application Priority Data

Feb. 3, 2020 (CN) ..... 202010079396.9

(51) Int. Cl.
*A24F 40/465* (2020.01)
*A24F 13/02* (2006.01)
*A24F 40/20* (2020.01)

(52) U.S. Cl.
CPC ..... *A24F 40/465* (2020.01); *A24F 13/02* (2013.01); *A24F 40/20* (2020.01)

(58) Field of Classification Search
CPC ..... A24F 40/465; A24F 40/20; A24F 13/02
USPC ..... 131/329
See application file for complete search history.

(56) References Cited

U.S. PATENT DOCUMENTS

2017/0055580 A1* 3/2017 Blandino et al. ..... A24F 47/008

OTHER PUBLICATIONS

Plastic Definition. Merriam-Webster Dictionary Online, https://www.merriam-webster.com/dictionary/plastic, Retrieved Feb. 6, 2023 (Year: 2023).*
Nylon Definition. Dictionary.com, http://www.dictionary.com/browse/nylon, Retrieved Feb. 6, 2023 (Year: 2023).*

* cited by examiner

*Primary Examiner* — Michael J Felton
*Assistant Examiner* — Ronnie Kirby Jordan
(74) *Attorney, Agent, or Firm* — MATTHIAS SCHOLL P.C.; Matthias Scholl

(57) ABSTRACT

A tobacco roaster includes an electromagnetic induction roasting module. The electromagnetic induction roasting module comprises a cup, a metal insert, and a magnetic induction coil. The metal insert is disposed in the cup. In a power-on state of the magnetic induction coil, the metal insert produces heat to heat a tobacco material in the cup to produce smoke.

8 Claims, 3 Drawing Sheets

TOBACCO ROASTER

CROSS-REFERENCE TO RELATED APPLICATIONS

Pursuant to 35 U.S.C. § 119 and the Paris Convention Treaty, this application claims foreign priority to Chinese Patent Application No. 202010079396.9 filed on Feb. 3, 2020, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to a tobacco roaster.

A conventional tobacco roaster comprises a heating wire, a heating net, and a heating pipe which cooperate to heat the tobacco material. In addition, the conventional tobacco roaster has no over-temperature protection function.

SUMMARY

The disclosure provides a tobacco roaster comprising an electromagnetic induction roasting module. The electromagnetic induction roasting module comprises a cup, a metal insert, and a magnetic induction coil; the metal insert is disposed in the cup; in a power-on state of the magnetic induction coil, the metal insert produces heat to heat a tobacco material in the cup to produce smoke.

In a class of this embodiment, the tobacco roaster further comprises a temperature sensor; when a temperature of the electromagnetic induction roasting module reaches a preset temperature, the temperature sensor transmits a temperature signal to an over-temperature protection circuit of a control panel to reduce a power of the tobacco roaster.

In a class of this embodiment, the tobacco roaster further comprises a ceramic seat; the cup is disposed in the ceramic seat, and the ceramic seat is disposed in the magnetic induction coil.

In a class of this embodiment, the tobacco roaster further comprises a strip of thermal insulation cotton wrapped around the magnetic induction coil.

In a class of this embodiment, the tobacco roaster further comprises a silicone pad and a ceramic ring; the silicone pad is disposed on the ceramic ring, and the metal insert is disposed along an axial direction of the silicone pad and the ceramic ring.

In a class of this embodiment, the cup comprises high temperature resistant nylon material.

In a class of this embodiment, the tobacco roaster further comprises a second seal ring and a location sleeve; the location sleeve is disposed on the cup; the ceramic ring is disposed on a bottom end of the ceramic seat to fix the cup; the second seal ring is disposed between the cup and the location sleeve.

In a class of this embodiment, the tobacco material is a cigarette.

In a class of this embodiment, the tobacco roaster further comprises an anchor screw, a control panel, and a plurality of batteries; the plurality of batteries comprises an output end connected to an input end of the control panel, and an output end of the control panel fixedly connected to an input end of the magnetic induction coil via the anchor screw.

In a class of this embodiment, the temperature sensor is disposed on a bottom end of the ceramic seat.

DETAILED DESCRIPTION

To further illustrate, embodiments detailing a tobacco roaster are described below. It should be noted that the following embodiments are intended to describe and not to limit the disclosure.

Figure 1:
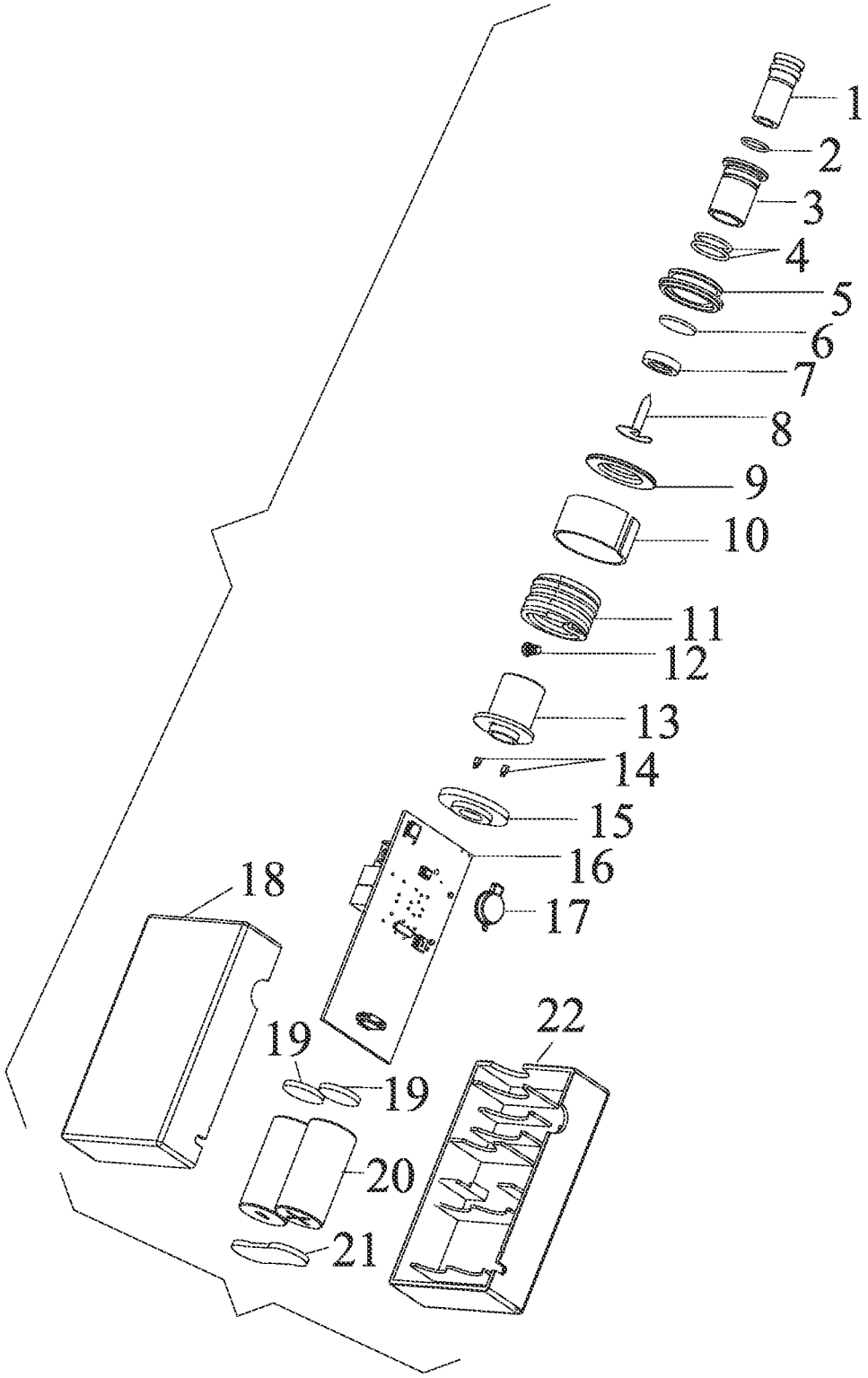
FIG. 1 is an exploded view of a tobacco roaster in accordance with one embodiment of the disclosure.
Figure 2:
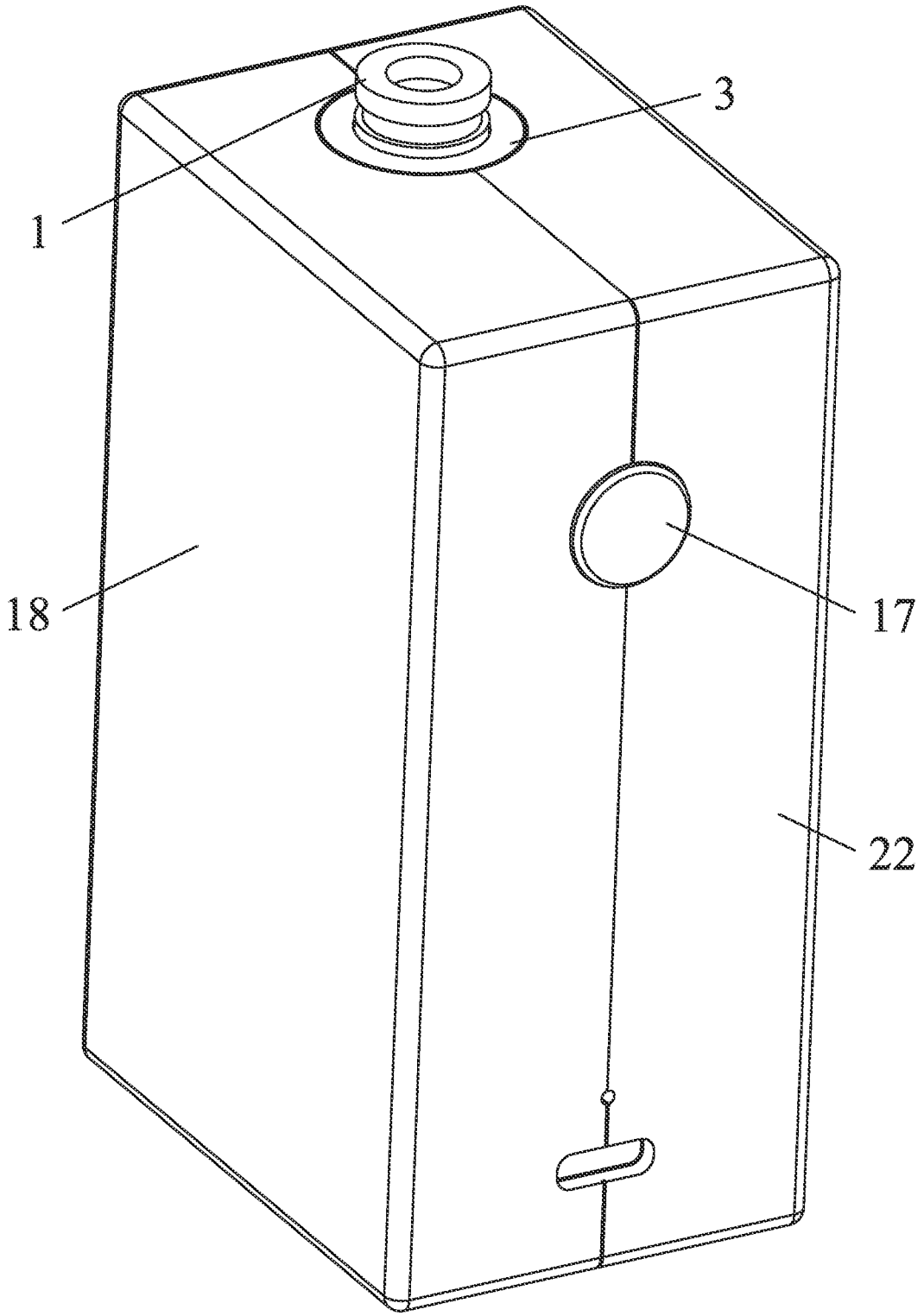
FIG. 2 is a schematic diagram of a tobacco roaster in accordance with one embodiment of the disclosure.
Figure 3:
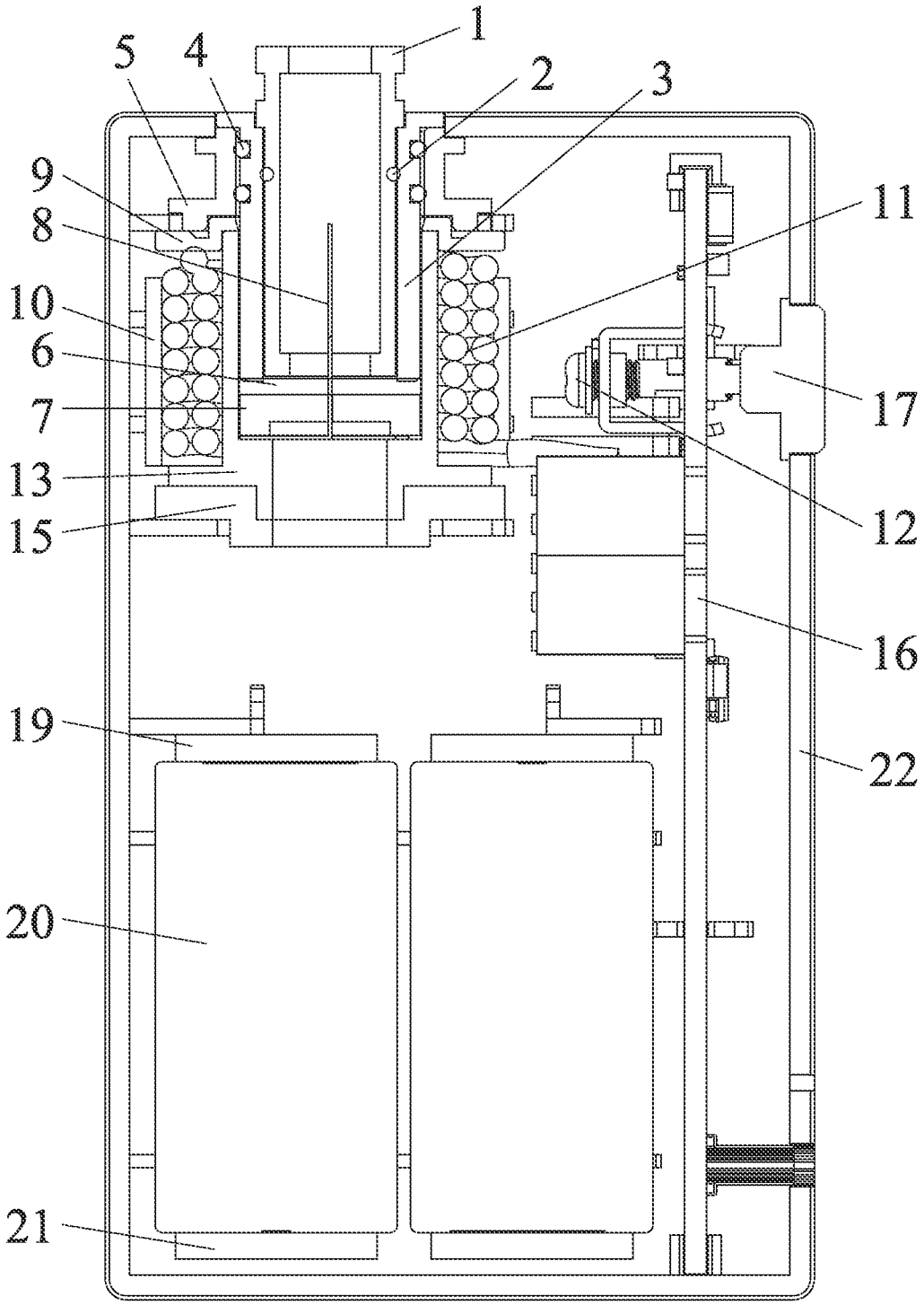
FIG. 3 is a sectional view of a tobacco roaster in accordance with one embodiment of the disclosure.

As shown in FIGS. 1-3, the disclosure provides a tobacco roaster comprising a mouthpiece 1, a first seal ring 2, a cup 3, a second seal ring 4, a location sleeve 5, a silicone pad 6, a ceramic ring 7, a metal insert 8, a silicone cover 9, a strip of thermal insulation cotton 10, a magnetic induction coil 11, an anchor screw 12, a ceramic seat 13, a temperature sensor 14, a silicone seat 15, a control panel 16, a button 17, a first cover 18, a pair of electrodes 19, a plurality of batteries 20, an electrode connector 21, and a second cover 22. The first seal ring 2 is disposed on the mouthpiece 1. The mouthpiece 1 is disposed in the cup 3 to fix the tobacco material. The silicone pad 6 is disposed on the ceramic ring 7. The metal insert 8 is disposed along the axial direction of the silicone pad 6 and the ceramic ring 7. The tobacco material is disposed around the metal insert 8. The ceramic ring 7 is disposed on the bottom end of the ceramic seat 13. The second seal ring 4 is disposed between the cup 3 and the location sleeve 5. The location sleeve 5 is disposed on the cup 3. The tobacco material is disposed in the cup 3. The cup 3 is disposed in the ceramic seat 13, and the ceramic seat 13 is disposed in the magnetic induction coil 11. The temperature sensor 14 is disposed on the bottom of the ceramic seat 13. The silicone seat 15 is disposed on the bottom of the ceramic seat 13 for fixing the ceramic seat 13 and isolating the electrode of the temperature sensor 14. The silicone cover 9 is disposed on the ceramic seat 13 to prevent the swaying of the ceramic seat 13. The strip of thermal insulation cotton 10 is wrapped around the magnetic induction coil 11 for heat insulation, so as to prevent the heat loss generated by the metal insert 8. The electrode connector 21 is connected to the plurality of batteries 20 to make the plurality of batteries 20 connected in series. The pair of electrodes 19 are respectively connected to the positive and negative electrodes of the plurality of batteries 20 for electric conduction. The input end of the control panel 16 is soldered on the pair of electrodes 19 on the input end of the plurality of batteries 20 to supply power to the control panel 16. The output end of the control panel 16 is fixedly connected to the input end of the magnetic induction coil 11 via the anchor screw 12 to supply power to the magnetic induction coil 11. The button 17 is disposed on the control panel. The batteries 20, the control panel 16, and the magnetic induction coil 11 are fixed in the second cover 22. The first cover 18 is connected to the second cover 22.

The tobacco roaster is designed based on the principle of electromagnetic induction. When the metal insert 8 is placed in the magnetic induction coil 11, a magnetic induction effect is generated, and an eddy current is formed to make the metal insert 8 heated. The cup 3 is made of high temperature resistant nylon material and does not generate heat.

The following advantages are associated with the tobacco roaster of the disclosure:

1. The tobacco roaster comprises the electromagnetic induction roasting module. The metal insert produces heat in the magnetic induction coil to heat the tobacco material.

2. The tobacco roaster comprises the metal insert and the tobacco material is inserted on the metal insert.

3. The tobacco roaster comprises the temperature sensor which can protect the tobacco roaster and improve the safety performance of the tobacco roaster.

It will be obvious to those skilled in the art that changes and modifications may be made, and therefore, the aim in the appended claims is to cover all such changes and modifications.

What is claimed is:

1. A tobacco roaster, comprising an electromagnetic induction roasting module, a temperature sensor, and a ceramic seat, wherein:

the electromagnetic induction roasting module comprises a cup, a metal insert, and a magnetic induction coil; the metal insert is disposed in the cup; in a power-on state of the magnetic induction coil, the metal insert produces heat to heat a tobacco material in the cup to produce smoke;

when a temperature of the electromagnetic induction roasting module reaches a preset temperature, the temperature sensor transmits a temperature signal to an over-temperature protection circuit of a control panel to reduce a power of the tobacco roaster;

the cup is disposed in the ceramic seat; and the ceramic seat is disposed in the magnetic induction coil.

2. The tobacco roaster of claim 1, further comprising a strip of thermal insulation cotton wrapped around the magnetic induction coil.

3. The tobacco roaster of claim 2, further comprising a silicone pad and a ceramic ring, wherein the silicone pad is disposed on the ceramic ring, and the metal insert is disposed along an axial direction of the silicone pad and the ceramic ring.

4. The tobacco roaster of claim 1, wherein the cup comprises high temperature resistant nylon material.

5. The tobacco roaster of claim 3, further comprising a second seal ring and a location sleeve, wherein the location sleeve is disposed on the cup; the ceramic ring is disposed on a bottom end of the ceramic seat to fix the cup; the second seal ring is disposed between the cup and the location sleeve.

6. The tobacco roaster of claim 4, wherein the tobacco material is a cigarette.

7. The tobacco roaster of claim 5, further comprising an anchor screw, a control panel, and a plurality of batteries; wherein the plurality of batteries comprises an output end connected to an input end of the control panel, and an output end of the control panel fixedly connected to an input end of the magnetic induction coil via the anchor screw.

8. The tobacco roaster of claim 1, wherein the temperature sensor is disposed on a bottom end of the ceramic seat.

* * * * *